United States Patent [19]

Cheng Wei

[11] Patent Number: 4,764,707

[45] Date of Patent: Aug. 16, 1988

[54] LIGHT BULB

[76] Inventor: Hsu Cheng Wei, No. 58, Cheng Chan St., Shih-Lin, Cheng, Taipei Hsien, Taiwan

[21] Appl. No.: 71,768

[22] Filed: Jul. 6, 1987

[51] Int. Cl.[4] ..... H01K 1/28; H01K 1/36

[52] U.S. Cl. ..... 313/580; 313/634; 313/636; 313/112; 445/27

[58] Field of Search ..... 445/22, 27; 313/634, 313/636, 580, 112

[56] References Cited

U.S. PATENT DOCUMENTS

| | | | |
|---|---|---|---|
| 2,969,479 | 1/1961 | Lawson | 313/636 X |
| 3,026,436 | 3/1962 | Hughes | 313/636 X |
| 4,428,039 | 1/1984 | Guimond et al. | 313/634 X |

*Primary Examiner*—Kenneth J. Ramsey

[57] ABSTRACT

A light bulb body which may be blow molded from transparent or translucent polymer resin. The resin for instance, polypropylene may be blended with fillers and fire-proof agents such as glass fiber, glass microparticles and nylon fiber. The molded light bulb is hermetically joined with the lamp stem, filled with an inert gas and is installed with the scrw lamp base. The "not-easy breakable" feature the said composite bulb body and the phenomena of color pigmentation, light refraction, total reflection and diffusion properties of the bulb material itself, thereby avoids the defects such as stereotype nature of a single material and vulnerability of the traditional glass bulbs.

10 Claims, 4 Drawing Sheets

LIGHT BULB

SUMMARY OF THE INVENTION

A synthetic bulb body and its forming method and, in particular, the lower temperature bulb body in different shapes which is blown and formed and under the high tempersture and in mold with transparent or translucent polymer resin (for instance, polypropylene (pp), etc.) blended with fillers and fire-proof agents such as glass fiber, glass microparticles and nylon fiber and also is joined with the lamp stem, tungsten filled with an inert gas and is installed with the screw lamp head (socket) to become a new bulb of a composite bulb body having "not-easy breakable" feature the said composite bulb body should cause the phenomena like light refraction, total reflection and diffusion to make the bulb itself have the crystal beautiful effects with soft or fancy colors, thereby improving the defects such as stereotype nature of a single material and vulnerability of the traditional glass bulbs.

A BRIEF DESCRIPTION ON THE DRAWINGS

Reference drawing: the structure of a common glass

FIGS. 1A, 1B, 1C, 1D and 1E subsequently show the forming of the synthesized bulb body of the bulb according to the present invention.

FIGS. 7, 8, 9 and 10 respectively show several examples of magnified view showing the use of glass fiber filler in the resin material of the synthetic bulb body of the bulb according to the present invention.

(1) bulb body of the bulb, (1*a*) neck, (1*b*) opening, (2) lamp stem, (3) annular hoop, (4) glass fiber (particulates), (5) resin, (6) inert gas

DETAILED DESCRIPTION OF THE PRESENT INVENTION

In the present invention, the bulb body of the bulb is made of the matrix of the moldable nontoxic material like glass polymer synthetic resin (for instance poly propylene).

Such a glass and resin composite of the organic matrix has several big special advantages: (1) light in weight (in approximately only a half of the weight of the glass in the same volume); (2) capable of being formed in various forms by different forming and its hardness to be controlled by the respective compositions contained therein; (3) high temperature-resistance (for instance, the composite made of 30% glass and poplypropylene can stand 159° C., and that made of 25% glass fiber filler and PP can stand 142° C.)—based on the general materials available in the markets; (4) a not-easy breakable characteristic (5) non-toxity. (note:

At present the material made with glass fiber blended with PP have been successfully employed in man-made teeth, artificial bone joints, optical instruments, man-made heat valves etc.)

In the present invention, approximately 30% of the above-said fiber glass (or particulates) blended into the resin PP is used as the matrix which is then added with fillers such as nylon fiber and fire-proof material as the forming material for the bulb body and the color (monocolor or multi-color mixture). transparency of the bulb body can be optionally adjusted and prepared according to the ration of the mixing componments.

Firstly, the above-said composite synthysized material is filled in the storge hopper, is also heated to the softening point approximately 300° C.'-400° C.', is then molded by a blower/former into a wide-mouthed bulb body (1) by the forming process shown in FIG. 1A through FIG. 1E. Those skilled in the art will recognize that the bulb body disclosed herein can be made to specific specifications and is strong enough to withstand vibration feeding or other mass production process. A neck (1*a*) may be provided at a place near the opening of said bulb body to accommodate the lamp stem.

Figure 1A:
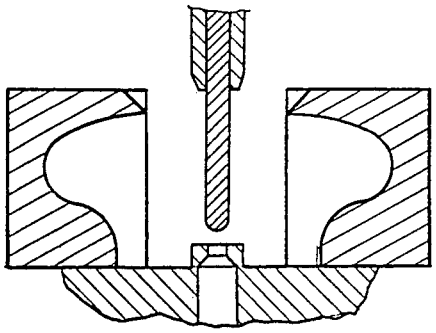
Figure 1B:
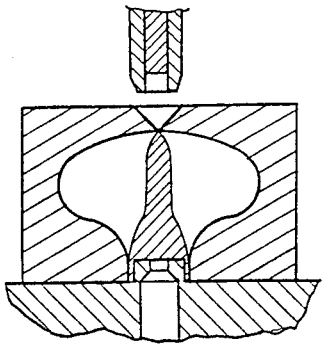
Figure 1C:
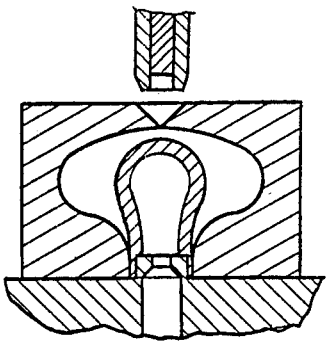
Figure 1D:
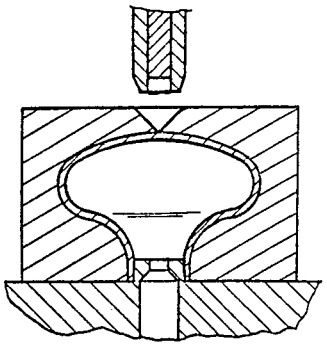
Figure 1E:
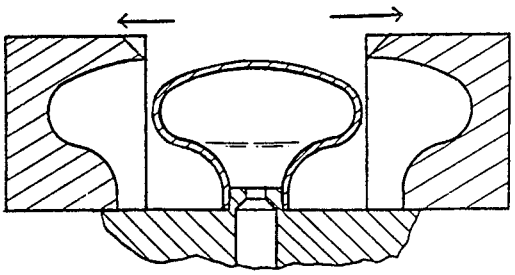
Figure 2:
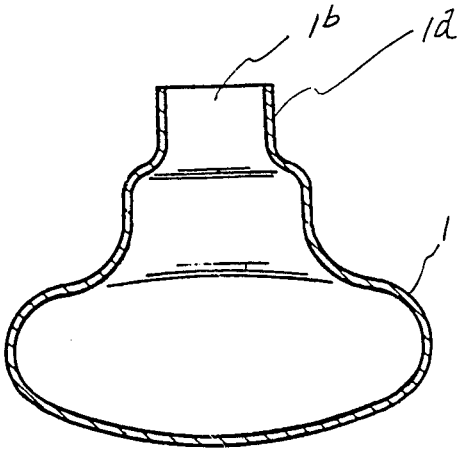
FIG. 2 is a structural view of the semi-finished product of the synthetic bulb body of the bulb according to the present invention.
Figure 3:
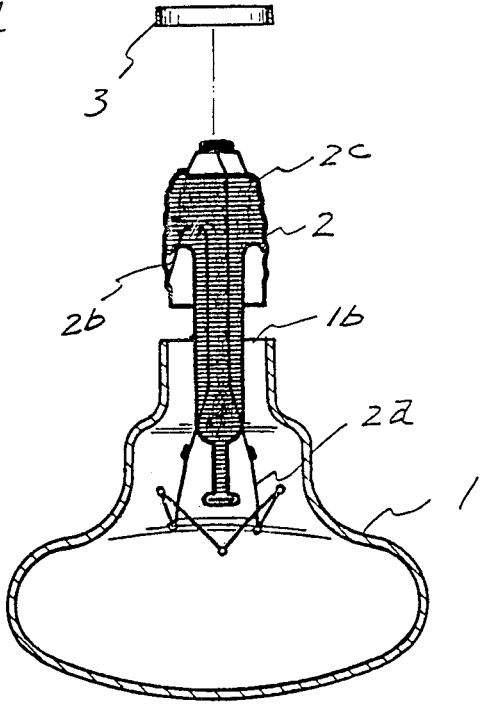
FIG. 3 is a view showing opposite installation position of the synthesized bulb body of the bulb according to the present invention.
Figure 4:
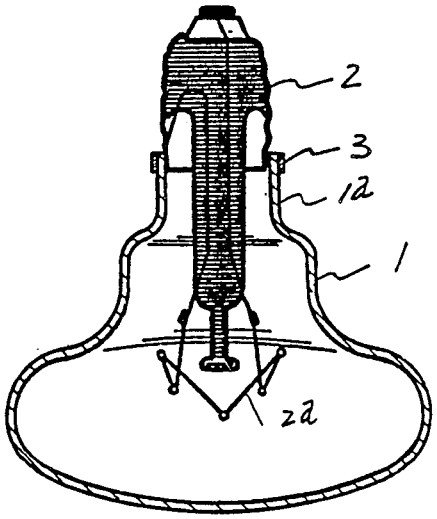
FIG. 4 is a view showing the joint between the synthetic bulb body of the and the bulb stem according to the present invention.
Figure 5:
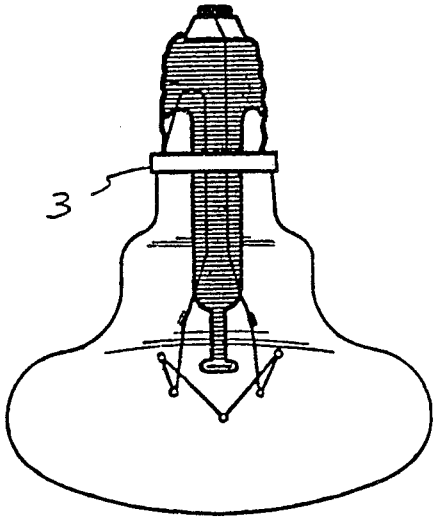
FIG. 5 is a view showing the joint between the synthetic bulb body of the bulb and the bulb stem according to the present invention.

As shown in FIG. 3 the bulb body (1) of the present invention is assembled over the base (2*c*) of a lamp stem having conventional tungsten lamp filaments (2*a*) and conductive lead wires (2*b*). An inital gap is reserved between the bulb and the bulb body. The thus assembled components are placed into a vacuum extractor to vacuate the air contained therein and to fill the bulb with an inert gas (for instance, nitrogen or argon). At the completion of the inert gas filling process and while the bulb is hot, an annular hoop (3) is applied to clamp and hermetically seal the bulb to the base.

After all the afore-mentioned joining procedures are completed, the bulb is set in a cooling trough to cool the bulb body off to totally eliminate the tension stress and pressure during the forming process.

Figure 6:
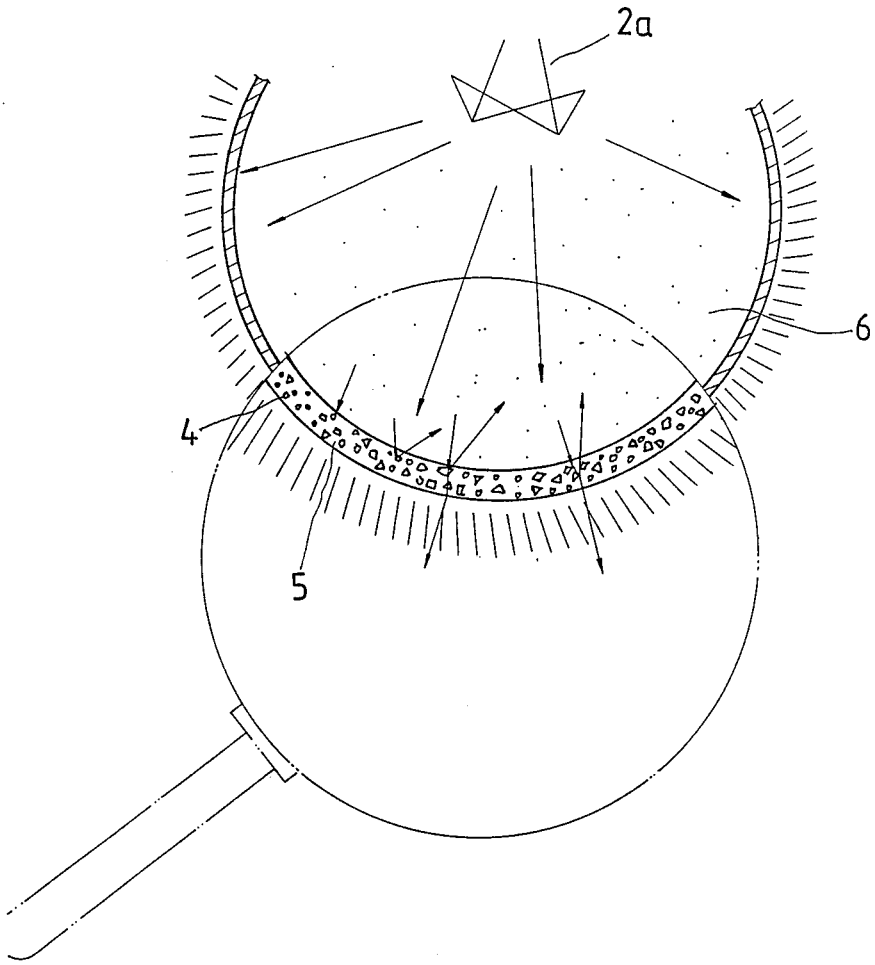
FIG. 6 is an larged cross sectional view of the wall of the synthetic bulb body of the bulb according to the present invention.
Figure 7:
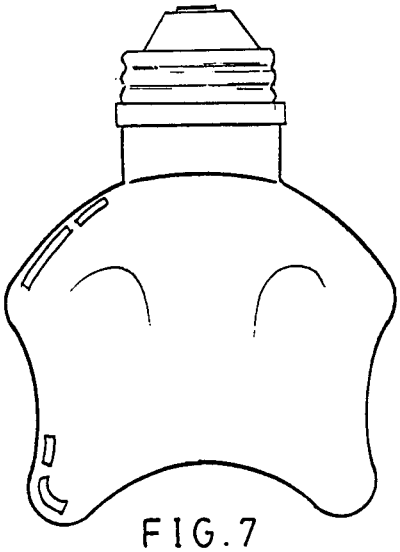
Figure 10:
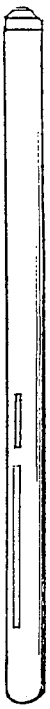
Figure 9:
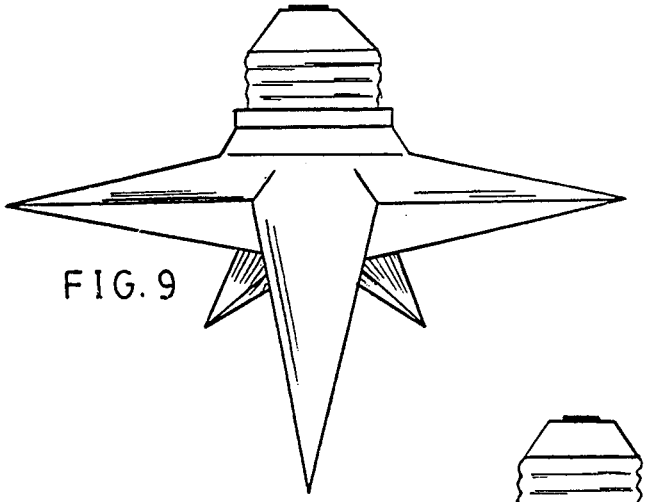
Figure 8:
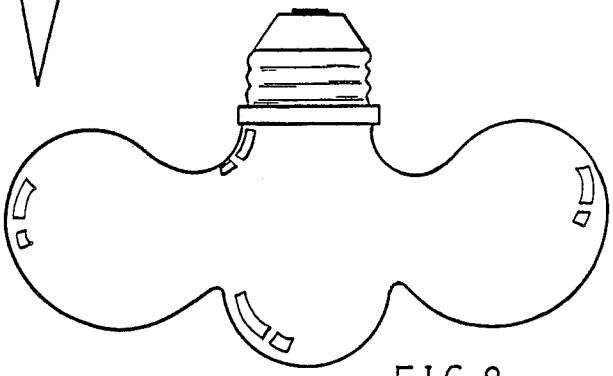

As shown in FIG. 6, since the wall of the bulb body of the bulb in this invention is made with the transparent poplypropylene (5), blended with glass fibre (particulates) (4), when the light passes through the wall of the bulb body, various interface of the wall will produce complex refraction and total reflection and the gas (6) in the bulb body will produce diffusion. Therefore, if and when the glass particulates are of various colored translucent grains (for instance, light blue, light purple), they will generate a mix of various colored lights to have a special crystal sparkling and pleasant appearance.

Summing all the above up, the composite synthetic bulb of the bulb relates to the entirely new material and utility model method of the light bulb as the first of its kind even available in history. Particularly its material and various techniques concerning the processing and forming have changed the original ways to produce the conventional bulbs.

I claim:

1. A light bulb comprising a molded bulb body of transparent or translucent synthetic plastic material having an opening, a stem assembly having incandescent lamp filaments and a base, and an annular hoop for securing the bulb body to said stem assembly; said stem assembly being sealed to and passing within the bulb opening to hermetically confine said lamp filaments within the bulb body whereby no hermetic envelope is provided between the lamp filaments and said synthetic plastic bulb body.

2. The light bulb as claimed in claim 1 wherein said plastic material is polypropylene blended with incombustible fillers.

3. The light bulb is claimed in claim 2 including colored fillers in the synthetic plastic material of the bulb body.

4. The light bulb as claimed in claim 3 wherein said incombustible fillers are selected from the class of glass fiber, nylon fiber, glass particulates and mixtures thereof.

5. The light bulb as claimed in claim 4 including an annular clamping ring secured around the opening of the bulb body.

6. The light bulb as claimed in claim 1 wherein the bulb body is shaped by a blow molding process.

7. The light bulb as claimed in claim 6 wherein the light bulb is of complex shape.

8. The light bulb as claimed in claim 1 wherein an inert gas fill is provided within the bulb body.

9. The light bulb as claimed in claim 1 including an annular clamping ring secured around the opening of the bulb body.

10. The light bulb as claimed in claim 1 including colored fillers in the synthetic plastic material of the bulb body.

* * * * *